US008909539B2

(12) United States Patent
Kim et al.

(10) Patent No.: US 8,909,539 B2
(45) Date of Patent: Dec. 9, 2014

(54) METHOD AND DEVICE FOR EXTENDING BANDWIDTH OF SPEECH SIGNAL

(71) Applicant: Gwangju Institute of Science and Technology, Buk-gu, Gwangju (KR)

(72) Inventors: Hong Kook Kim, Gwangju (KR); Nam In Park, Gwangju (KR)

(73) Assignee: Gwangju Institute of Science and Technology, Gwangju (KR)

( * ) Notice: Subject to any disclaimer, the term of this patent is extended or adjusted under 35 U.S.C. 154(b) by 213 days.

(21) Appl. No.: 13/708,346

(22) Filed: Dec. 7, 2012

(65) Prior Publication Data

US 2013/0151255 A1 Jun. 13, 2013

Related U.S. Application Data

(60) Provisional application No. 61/567,640, filed on Dec. 7, 2011.

(30) Foreign Application Priority Data

Apr. 9, 2012 (KR) ..... 10-2012-0036878

(51) Int. Cl.
*G10L 21/00* (2013.01)

(52) U.S. Cl.
USPC ..... 704/500; 704/200; 375/240

(58) Field of Classification Search
USPC ..... 704/200, 500; 375/240
See application file for complete search history.

(56) References Cited

U.S. PATENT DOCUMENTS

| | | | | |
|---|---|---|---|---|
| 7,904,293 | B2 * | 3/2011 | Wang et al. | 704/222 |
| 8,255,207 | B2 * | 8/2012 | Vaillancourt et al. | 704/219 |
| 2013/0282368 | A1 * | 10/2013 | Choo et al. | 704/219 |
| 2014/0019125 | A1 * | 1/2014 | Laaksonen et al. | 704/205 |

* cited by examiner

*Primary Examiner* — Daniel D Abebe
(74) *Attorney, Agent, or Firm* — Nath, Goldberg & Meyer; Joshua B. Goldberg

(57) ABSTRACT

A method for extending a bandwidth of a speech signal received, according to an embodiment of the present invention, includes: transforming the received speech signal into a frequency domain by decoding the received speech signal; normalizing the transformed speech signal; differentiating a voiced sound period or unvoiced sound period from the received speech signal; extracting, from the normalized speech signal, a first period including a harmonic component of the voiced sound period on the basis of the voiced sound period; extracting, from the normalized speech signal, a second period on the basis of correlation between the unvoiced sound period and the normalized speech signal; generating a high-band speech signal on the basis of the first period and the second period; and synthesizing the generated high-band speech signal and the transformed speech signal to output a wideband speech signal.

12 Claims, 5 Drawing Sheets

METHOD AND DEVICE FOR EXTENDING BANDWIDTH OF SPEECH SIGNAL

CROSS-REFERENCE TO RELATED APPLICATION

This application claims priority to U.S. Patent Application No. 61/567,640 filed on 7 Dec. 2011 and Korean Patent Application No. 10-2012-0036878 filed on 9 Apr. 2012, and all the benefits accruing therefrom under 35 U.S.C. §119, the contents of which are incorporated by reference in their entirety.

BACKGROUND

The present invention disclosed herein relates to a method and device for extending a bandwidth of a vocal signal, and more particularly, to a method and device for extending a bandwidth of a vocal signal for improving performance.

In most speech communication systems, the speech bandwidth is limited to a range of 0.3 kHz to 3.4 kHz. This speech bandwidth includes voiced sounds and unvoiced sounds. Since this speech bandwidth is low, the quality of original sounds is degraded. In order to overcome this limitation, a wideband speech receiver has been proposed. Wideband speech, of which bandwidth ranges from 50 Hz to 7 kHz, can represent all speech bands including voiced/unvoiced sounds and improve naturalness and clarity in comparison with narrowband speech. However, narrowband speech is currently popularly serviced with a narrowband speech codec in many applications such as voice communications over a public switched telephone network (PSTN), voice over IP (VoIP), and voice applications in smart phones. Therefore, it takes a lot of time and requires high cost to replace the narrowband speech codec with a wideband speech codec.

To overcome this limitation, it has been proposed to receive narrowband speech and convert the received speech into a wideband signal at a decoder. Accordingly, various methods for extending the speech bandwidth have been proposed.

One of the methods is allocating an additional bit for wideband. According to this method, side information is used. That is, by using encoding information transmitted from an encoder, high-band specch is generated. The encoder generates and transmits auxiliary information based on analysis of high frequency band information of an input signal. Here, the decoder generates a high frequency band signal based on transmitted auxiliary information. For instance, the wideband speech codec G.729.1 may provide coding with 12 different bit rates between 8 kbit/s and 32 kbit/s. The baseline coder of G.729.1 is fully compatible with G.729 that is a representative narrowband codec, thereby ensuring narrowband speech quality in 8 kbit/s mode. Here, the encoder generates wideband speech from the 14 kbit/s mode, of which operation mode is called 'layer 3', by using the above-described bandwidth extension technique. The encoder allocates additional bits for the bandwidth extension technique used in layer 3 of G.729.1 so that the high frequency band signal is generated during a decoding operation. However, this bandwidth extension technique requires additional bits, causing network overload. Moreover, this technique also requires modification of the encoder.

A method for generating a high frequency band signal from a low frequency band signal in a decoder without allocating additional bits has been proposed. For instance, for this method, estimation through a pattern recognition algorithm such as a hidden Markov model (HMM) and a Gaussian mixture model (GMM) has been proposed. However, the pattern recognition requires a training process, and performance may be variable according to language. Further, in the case where prediction or estimation is needed, additional bits are included and computational complexity is increased. Therefore, it is difficult to efficiently and rapidly process speech received in real time. In addition, various methods for extending bandwidth without allocating additional bits are limited in quality of output speech.

SUMMARY

The present invention provides a method and device for rapidly and efficiently extending a bandwidth of a narrowband speech signal.

The present invention also provides a method and device for extending a bandwidth of a speech signal which are capable of improving the quality of a bandwidth-extended speech signal without additional bits, thereby reducing cost and improving performance.

In accordance with an exemplary embodiment of the present invention, a method for extending a bandwidth of a speech signal received includes: transforming the received speech signal into a frequency domain by decoding the received speech signal; normalizing the transformed speech signal; differentiating a voiced sound period or unvoiced sound period from the received speech signal; extracting, from the normalized speech signal, a first period including a harmonic component of the voiced sound period on the basis of the voiced sound period; extracting, from the normalized speech signal, a second period on the basis of correlation between the unvoiced sound period and the normalized speech signal; generating a high-band speech signal on the basis of the first period and the second period; and synthesizing the generated high-band speech signal and the transformed speech signal to output a wideband speech signal.

In accordance with another exemplary embodiment of the present invention, a device for extending a bandwidth of a speech signal includes: a receiving unit configured to receive a speech signal; a decoder configured to decode the speech signal; a domain transform unit configured to transform the decoded speech signal into a frequency domain; a normalization unit configured to normalize the transformed speech signal; a determination unit configured to differentiate a voiced sound period or unvoiced sound period from the received speech signal; a voiced sound processing unit configured to extract, from the normalized speech signal, a first period including a harmonic component of the voiced sound period on the basis of the voiced sound period; an unvoiced sound processing unit configured to extract, from the normalized speech signal, a second period on the basis of correlation between the unvoiced sound period and the normalized speech signal; a high-band generation unit configured to generate a high-band speech signal on the basis of the first period and the second period; and an output unit configured to synthesize the generated high-band speech signal and the transformed speech signal to output a wideband speech signal.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
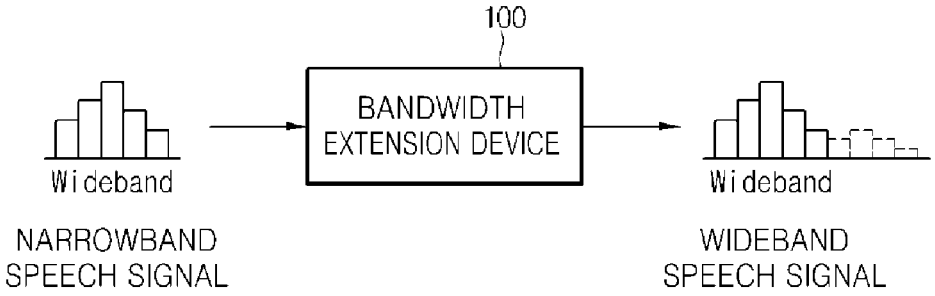
FIG. 1 is a diagram schematically illustrating a bandwidth extension device of a speech signal according to an embodiment of the present invention.

The following description only illustrates the principles of the present invention. Therefore, those skilled in the art can derive various devices that implement the principles of the present invention and are included in the concept and scope of the present invention even if the devices are not explicitly described or illustrated herein. It should be understood that the conditional terms and embodiments of the present disclosure are provided so that the concept of the present invention can be understood and it should be understood that the present invention is not limited to the specified embodiments and states.

Further, it should be understood that not only the principles, aspects, and embodiments of the present invention but also all detailed descriptions of specific embodiments include structural and functional equivalents thereof. Further, it should be understood that these equivalents include not only published equivalents but also equivalents that will be developed, i.e. all devices designed to perform the same functions regardless of structures.

Therefore, for instance, it should be understood that the block diagrams of the present disclosure illustrate conceptual aspects of exemplary circuits that realize the principles of the present invention. Similarly, it should be understood that all flowcharts, state transition diagrams, and pseudo codes represent various processes that are performed by a computer or processor regardless of whether the flowcharts, state transition diagrams, and pseudo codes can be substantially indicated in a computer-readable medium or the computer or processor is explicitly illustrated.

Functions of devices illustrated in the drawings including function blocks represented as a processor or similar concept can be provided by dedicated hardware as well as hardware capable of executing pertinent software. When the functions are provided by a processor, the functions may be provided by a single dedicated processor, a single shared processor, or multiple individual processors, and a part thereof may be shared.

Further, the terms suggested as a processor, control, or similar concept thereof should not be interpreted by exclusively referring to hardware capable of executing software, but should be interpreted to include digital signal processor (DSP) hardware and ROM, RAM, and non-volatile memory for storing software. Well-known another hardware may be included.

In the claims, the elements expressed as means for performing the functions described in the detailed description include a combination of circuits for performing the functions or all methods for performing functions including all types of software including firmware/micro code. The elements are connected to appropriate circuits to execute the functions, thereby performing the functions. Since the present invention defined by the claims combines functions provide by listed means in a manner required by the claims, it should be understood that any means capable of providing the functions are equivalent to those of the present disclosure.

Hereinafter, specific embodiments will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Moreover, detailed descriptions related to well-known functions or configurations will be ruled out in order not to unnecessarily obscure subject matters of the present invention.

Hereinafter, embodiments of the present invention will be described in detail with reference to the accompanying drawings.

FIG. 1 is a diagram schematically illustrating a bandwidth extension device of a speech signal according to an embodiment of the present invention.

Referring to FIG. 1, a bandwidth extension device 100 of a speech signal according to an embodiment of the present invention receives a narrowband speech signal and outputs a wideband speech signal having improved sound quality. The bandwidth extension device 100 may be used in a decoder of a narrowband speech receiver, and may generate and output a wideband speech signal maintaining harmonic components of narrowband. The bandwidth extension device 100 may distinguish voiced sounds or unvoiced sounds by using information obtained while a narrowband speech signal is decoded. Further, the bandwidth extension device 100 may obtain the wideband speech signal maintaining harmonic components by using pitch information in the case of voiced sounds, and may obtain the wideband speech signal by using a signal having a highest degree of correlation in the case of unvoiced sounds. By adjusting energy of the obtained wideband speech signal, a sound-quality-improved wideband speech signal may be outputted without adding bits.

Figure 2:
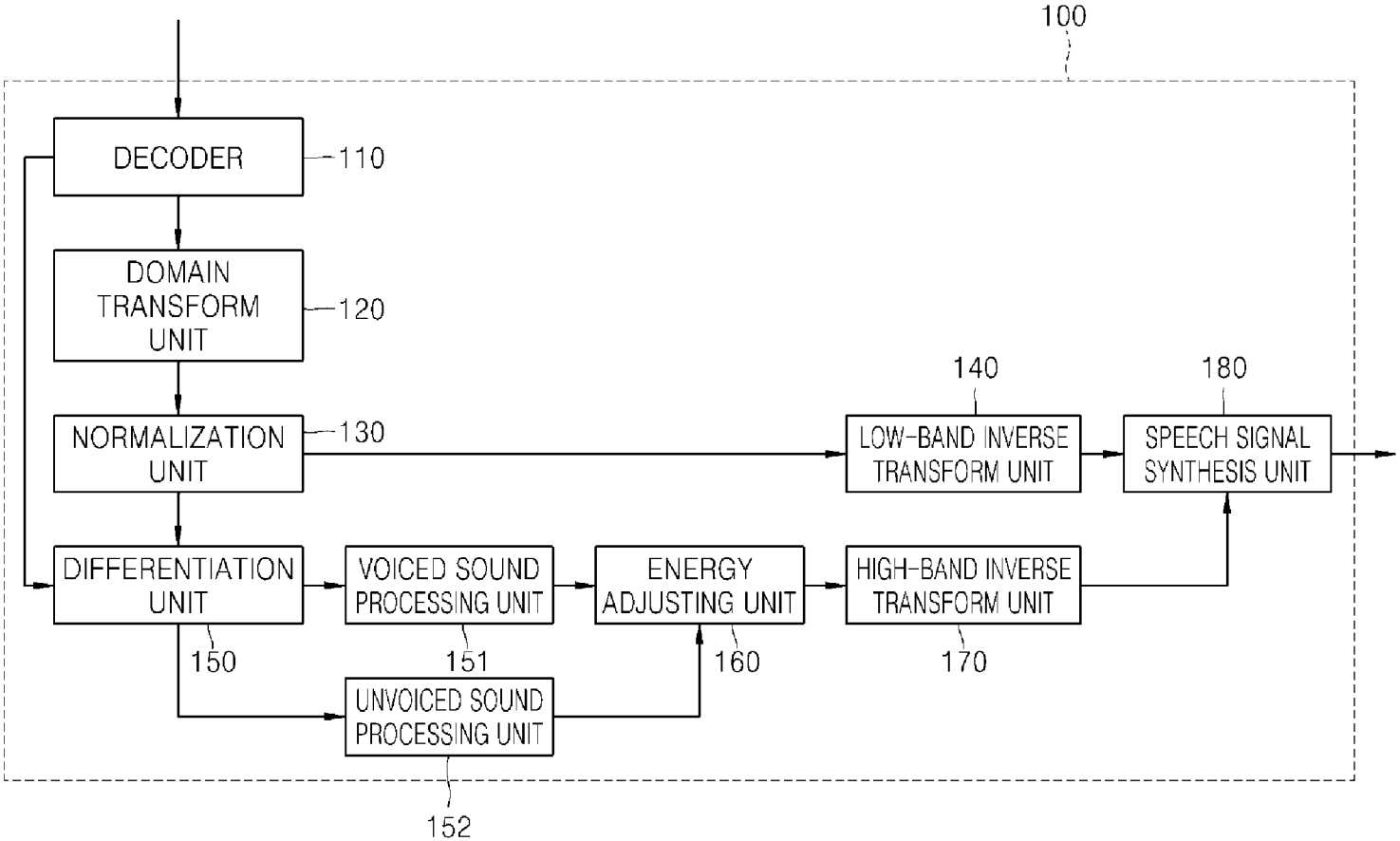
FIG. 2 is a block diagram illustrating in more detail the bandwidth extension device of a speech signal according to an embodiment of the present invention.

FIG. 2 is a block diagram illustrating in more detail the bandwidth extension device of a speech signal according to an embodiment of the present invention.

As illustrated in FIG. 2, the bandwidth extension device 100 according to an embodiment of the present invention includes: a decoder 110 which receives a speech signal and decodes the received speech signal into processible data; a domain transform unit 120 which transforms the decoded speech signal into a frequency domain; a normalization unit 130 which normalizes the domain-transformed speech signal; a low-band inverse transform unit 140 which inversely is transformed into a low-band speech signal of a time domain; a differentiation unit 150 which differentiates a voiced sound or unvoiced sound period of the domain-transformed speech signal; a voiced sound processing unit 151 which obtains a first period including a harmonic period from a period differentiated as a voiced sound; an unvoiced sound processing unit 152 which obtains a second period having a highest degree of correlation from a period differentiated as an unvoiced sound; an energy adjusting unit 160 which performs energy scaling to the first or second period; a high-band inverse transform unit 170 which inversely transforms the energy-adjusted speech period to output a high-band speech signal of a time domain; and a speech signal synthesis unit 180 which synthesizes a low-band speech signal output and a high-band speech signal output in order to output a wideband speech signal.

The decoder 110 receives a speech signal and decodes the received signal into processible data. Various methods may be used to decode a speech signal. For instance, the decoder 110 may perform decoding by using a well-known narrowband decoding method, i.e. G.729 [ITU-T Recommendation G.729, Coding of speech at 8 kbit/s using conjugate-structure code-excited linear prediction (CS-ACELP)]. Further, the decoder 110 may include a code exited linear prediction (CELP)-type speech decoder based on spectrum analysis.

In one embodiment, the decoder 110 may extract pitch information or frequency slope of a speech signal during a decoding process, and may transmit the extracted pitch information or frequency slope to the differentiation unit 150. For instance, the decoder 110 may obtain the frequency slope by using a primary reflection coefficient for decoding the received speech signal with G.729, and may transmit the frequency slope to the differentiation unit 150.

In one embodiment, the decoder 110 may decode a bitstream according to a speech signal into a narrowband speech signal. For instance, the number of samples for 1 frame size, i.e. N, may be 80 for a speech signal of G.729 format which is processed in the decoder 110.

The domain transform unit 120 transforms a decoded speech signal into a frequency domain. The domain transform unit 120 may obtain data of a frequency domain on the basis of the decoded speech signal.

For instance, the domain transform unit 120 may transform a speech signal into a frequency domain by using modified discrete cosine transform (MDCT). The domain transform unit 120 receives the decoded speech signal as an input signal of a time domain, transforms the received signal into an input signal of a frequency domain, and performs an overlap operation between blocks. In particular, according to the MDCT method, a bit rate is not increased even if the overlap operation is performed. Further, as described above, in the case where the number of samples for 1 frame, i.e. N, is 80 for a speech signal of G.729 format, the domain transform unit 120 may be 2N-point MDCT which outputs 2N, i.e. 160, frequency band points and coefficients thereof from a decoded one speech frame.

The normalization unit 130 performs normalization to a domain-transformed speech signal. The normalization unit 130 may group domain-transformed speech signal data into a plurality of sub-bands, and may perform normalization to frequency band coefficients for each sub-band with energy for each sub-band. For instance, in the case where 80 frequency band points are grouped into 16 sub-bands, each sub-band may include 5 MDCT coefficients. In this case, a normalization process may be expressed as following equations.

$$E(b) = \sqrt{\sum_{k=5b}^{k=5(b+1)-1} S_l^2(k)}\ ,\ b = 0, 1, \ldots, 15 \tag{1}$$

$$\overline{S_l}(k) = \frac{S_l(k)}{E(b)},\ 5b \le k < 5(b+1) \tag{2}$$

Where E(b) of Equation (1) may represent energy of a bth sub-band on frequency band points of an MDCT-transformed speech signal. In the present embodiment, since the number of sub-bands is 16, 'b' may be an integer ranging from 0 to 15.

Equation (2) represents a method for normalizing coefficients for each MDCT-transformed frequency by using the energy of sub-band obtained as described above. $S_l(k)$ may represent a kth normalized MDCT coefficient.

The differentiation unit 150 differentiates a voiced sound or unvoiced sound on the basis of a normalized speech signal. The differentiation unit 150 may receive a spectral tilt obtained during the decoding process of the decoder 110, and may differentiate a voiced sound period when the spectral tilt is equal to or greater than a certain value.

For instance, in the case where the decoder 110 is a CELP-type speech decoder, the voiced sound period may be differentiated by extracting spectral tilt information from information outputted from the decoder 110.

In the case of the decoder 110 using G.729, during a decoding process, a primary reflection coefficient, i.e. St, is obtained through following Equation (3) and may be transmitted to the differentiation unit 150.

$$St = \frac{\sum_{n=1}^{N-1} s(n)s(n-1)}{\sum_{n=1}^{N-1} s^2(n)} \tag{3}$$

Where s(n) may represent a value of an nth sample of one frame in a time domain of a received speech signal.

The differentiation unit 150 may receive the obtained spectral tilt St from the decoder 110 or may calculate the spectral tilt, and may compare the spectral tilt with a predefined θst. When St is equal to or greater than θst, the voice sound period may be differentiated. θst may be preset by a user, and may be set to approximately 0.25 according to a result of an experiment. The differentiation unit 150 may determine a period, which is not determined as a voice period, as an unvoiced period. Here, the differentiation unit 150 does not directly calculate a spectral tilt, but receives spectral tilt information generated during a decoding process of a speech signal, thereby reducing computational complexity.

The voiced sound processing unit 151 obtains a first period including a harmonic period from a period differentiated as voiced sounds. The voiced sound processing unit 151 may extract the harmonic period from a period differentiated as voiced signals of a normalized speech signal by using the pitch information obtained from the decoder 110. The first period may include a plurality of periods as harmonic periods, or the first period may be plural.

The pitch information may represent a pitch period of a speech, and may include location and interval information of harmonics in a frequency domain. In the case of voiced sounds, a speech signal has harmonic characteristic by a period according to the pitch information. Therefore, the voiced sound processing unit 151 may extract the harmonic period of the voiced sound period. In particular, during a decoding process of a speech signal in the decoder 110, the pitch information may also be extracted, and computational complexity may be reduced by using this pitch information. Since computation is performed only at a voiced sound period, the harmonic period may be rapidly extracted.

Here, the decoder 110 or voiced sound processing unit 151 may extract pitch information T by using Equations (4) and (5) shown below.

$$R(\tau) = \frac{\sum_{n=\tau}^{N-1} s(n)s(n-\tau)}{\sqrt{\sum_{n=1}^{N-1} s^2(n)}} \tag{4}$$

$$T = \text{argmax}_{P_l \le \tau \le P_h} R(\tau) \tag{5}$$

Where 'T' may represent a value of τ that maximizes R(τ) through Equation (4). 'T' is a pitch value, and $P_1$ and $P_h$ may be respectively 20 and 147.

The voiced sound processing unit 151 may extract the harmonic period from the voiced sound period on the basis of the obtained pitch information T. According to the pitch information T, a harmonic period in a 2N-point-transformed MDCT frequency domain may be calculated by using Equations (6) and (7) shown below.

$$\Delta_v = \frac{2N}{T} \tag{6}$$

$$\overline{S_l'}(k) = \overline{S_l}\left(k + \frac{N}{2} - \lfloor \Delta_v - \text{mod}(N, \Delta_v) \rfloor\right) \tag{7}$$

Where 'T' may represent pitch information, 'N' may represent the number of samples per one frame, and may represent MDCT coefficients of a speech signal normalized in the normalization unit 130 through Equation (2). Mod(x,y) may represent modular arithmetic of x % y, and may represent the greatest integer that is not greater than x. 'k' may range from 0 to N/2−1 according to the number of samples. By calculations according to Equations (6) and (7), outputted $\overline{S}_1'(k)$ may include MDCT coefficients obtained by extracting the harmonic period from the voiced sound period in the differentiation unit 150. Therefore, by outputting, $\overline{S}_1'(k)$ the voiced sound processing unit 151 may extract output data of the harmonic period for the voiced sound period.

The unvoiced sound processing unit 152 obtains a second period having a highest degree of correlation from a period determined as unvoiced sounds. The unvoiced processing unit 152 may determine cross-correlation for each frequency period for a period determined as unvoiced sounds in a normalized speech signal, and may extract a period having a highest degree of cross-correlation to thereby obtain the second period. The obtained second period may range from approximately 3 kHz to approximately 4 kHz. Thereafter, the second period may be amplified and changed to a high band so as to be used as an unvoiced sound period of a high-band speech signal. This may be calculated by the following equations.

$$\Delta_{uv} = \arg\max_m \text{corr}(\overline{S_l}(k), \overline{S_l}(k+m)) \tag{8}$$

Δuv may represent a value 'm' that satisfies maximum correlation according to a frequency band order k in an unvoiced sound period of a normalized speech signal Therefore, 'm' may be one of integers from 0 to N/4−1. The correlation calculation in Equation (8) is expressed as Equation (9) in more detail.

$$\text{corr}(\overline{S_l}(k), \overline{S_l}(k+m)) = \sum_{k=0}^{N/4-1} \overline{S_l}\left(k + \frac{3}{4}N\right)\overline{S_l}(k+m) \tag{9}$$

Therefore, MDCT coefficients corresponding to a frequency band with highest degree of correlation may be calculated by using Equation (10).

$$\overline{S_l'}(k) = \overline{S_l}\left(k + \frac{N}{4} + \Delta_{uv}\right) \tag{10}$$

Where 'k' may represent one of integers from 0 to N/2−1. The unvoiced sound processing unit 15 calculated $\overline{S}_1'(k)$ as an unvoiced sound period of a high frequency band on the basis of the correlation. The outputted unvoiced sound period, i.e. the second period, may include a plurality of periods like the first period, or the second period may be plural.

A bandwidth amplification process is performed for the first period or second period obtained by the voiced sound processing unit 151 or unvoiced sound processing unit 152. The voiced sound processing unit 151 or unvoiced sound processing unit 152 outputs $\overline{S}_1'(k)$, which is outputted according to Equation (7) or (10), as the first period or second period. By using this process, a bandwidth of a frequency band is reduced by half. For instance, in the case where a desired bandwidth is 4 kHz, $\overline{S}_1'(k)$ may have a bandwidth of 2 kHz. Therefore, the voiced sound processing unit 151 or unvoiced sound processing unit 152 may amplify a bandwidth by performing calculation of Equation (11).

$$\overline{S_h}(k) = \begin{cases} \overline{S_l'}(k/2), & k = 0, 2, \ldots, N-2 \\ 0, & k = 1, 3, \ldots, N-1 \end{cases} \tag{11}$$

Where $\overline{S}_h(k)$ may represent MDCT coefficients of a frequency domain normalized to kth order.

The energy adjusting unit 160 performs energy scaling to an MDCT frequency domain speech signal of the first or second period obtained by determining voiced sounds or unvoiced sounds.

The energy adjusting unit 160 serves to avoid an abrupt energy change when transformation into a high-band signal is performed by adjusting each coefficient of the MDCT speech signal of the first or second period.

Therefore, the energy adjusting unit 160 matches energy on a boundary portion between a low-band speech signal and a speech signal obtained by changing the first period or second period to a high band so as to adjust an abrupt energy change through scale adjustment. For instance, the energy adjusting unit 160 may adjust energy scale according to processes expressed as Equations (12) to (14) shown below.

$$E_h(b) = \begin{cases} \alpha E(b+7), & \text{if } E(b+8) > \alpha E(b+7) \\ E(b+8), & \text{otherwise} \end{cases} \tag{12}$$

Where $E_h(b)$ may represent energy of a bth frequency band of a high-band period. 'b' may be an integer ranging from 0 to 7. E(b) may represent energy of a bth frequency band of a low-band frequency band as defined in Equation (1).

A scale factor β for energy scaling at a boundary portion between a low-band period and a high-band period may be determined by Equation (13) shown below.

$$\beta = \frac{E(15)}{E_h(0)} \tag{13}$$

E(15) may represent energy of a sub-band of a highest band among the above-described 0 to 15 sub-band frequency bands in a low-band period, and Eh(0) may represent energy of an initial sub-band frequency band among sub-band frequency bands in a high-band period. As described above, the energy adjusting unit 160 may obtain the energy scaling factor by calculating an energy ratio between the two frequency bands.

An energy value of scale-adjusted high band is expressed as Equation (14) shown below.

$$\hat{E}_h(b)=\beta E_h(b),\ b=0,1,\ldots,7 \tag{14}$$

The high-band speech signal data obtained from Equation (14) needs bandwidth extension as described above with respect to Equation (11). Therefore, the energy adjusting unit 160 may increase the bandwidth of a speech signal of a high frequency band by performing a calculation of Equation (15).

$$\overline{E_h}(b) = \begin{cases} \hat{E}_h(b/2), & b = 0, 2, \ldots, 14 \\ E_h(b-1), & b = 1, 3, \ldots, 15 \end{cases} \tag{15}$$

Further, the energy adjusting unit 160 may output the speech signal of the high frequency band as expressed in Equation (16) by using Equations (11) and (15).

$$\tilde{S}_h(k)=\overline{S_h}(k)\overline{E_h}(b),\ b=\lfloor k/5 \rfloor \tag{16}$$

As described above, the energy adjusting unit 160 may output energy-adjusted $\tilde{S}_h(k)$ by performing energy adjusting for the first period or second period that is to be transformed into a high-band speech signal on the basis of an energy value of a normalized speech signal.

The speech signal synthesis unit 180 synthesizes the energy-adjusted high-band speech signal and the speech signal outputted from the normalization unit 130 in order to generate a wideband speech signal and transforms the signal into a time domain from a frequency domain. To this end, the speech signal synthesis unit 180 may perform a calculation of Equation (17) shown below and may transform data to be outputted into a time domain in order to output a wideband speech signal.

$$\tilde{S}_w(k) = \begin{cases} \tilde{S}_l(k), & \text{if } 0 \le k \le N-1 \\ \tilde{S}_h(k), & \text{if } 0 \le k \le 2N-1 \end{cases} \tag{17}$$

According to another embodiment of the present invention, the bandwidth extension device 100 may further include the low-band inverse transform unit 140 and the high-band inverse transform unit 170 as illustrated in FIG. 2.

The low-band inverse transform unit 140 may inversely be transformed into a low-band speech signal of a time domain to output of a time domain.

The high-band inverse transform unit 170 may inversely transform an energy-adjusted speech signal into a high-band speech signal of a time domain to output of a time domain.

The speech signal synthesis unit 180 may synthesize the low-band speech signal and high-band speech signal outputted in a time domain in order to output a filtered speech signal. To this end, the speech signal synthesis unit 180 may perform speech synthesis using quadrature mirror filterbank (QMF). A 64-band complex QMF may be used for the QMF.

Figure 3:
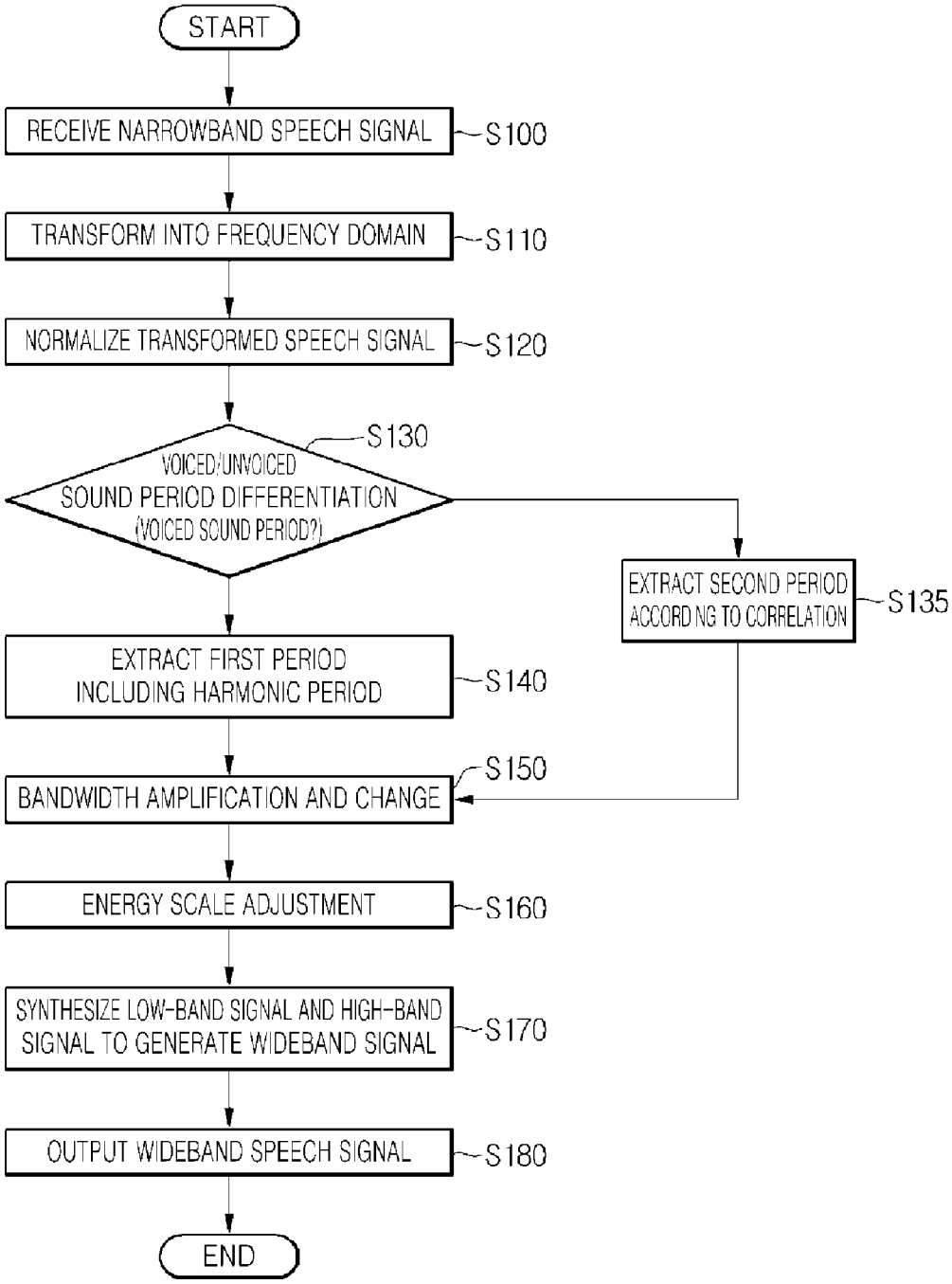
FIG. 3 is a flowchart illustrating a method for extending a bandwidth of a speech signal according to an embodiment of the present invention.

FIG. 3 is a diagram illustrating a method for extending a bandwidth of a speech signal according to an embodiment of the present invention.

Referring to FIG. 3, the decoder 110 receives a narrowband speech signal in operation S100. To decode a speech signal, the above-described narrowband decoding method, i.e. G.729 [ITU-T Recommendation G.729, Coding of speech at 8 kbit/s using conjugate-structure code-excited linear prediction (CS-ACELP)], may be used. Further, the decoder 110 may perform decoding by using a code exited linear prediction (CELP)-type speech decoder based on spectrum analysis.

The domain transform unit 120 transforms a decoded speech signal into a frequency domain in operation S110. As described above, the domain transform unit 120 may transform a speech signal into a frequency domain by using modified discrete cosine transform (MDCT).

As described above, the domain transform unit 120 receives the decoded speech signal as an input signal of a time domain, transforms the received signal into an input signal of a frequency domain, and performs an overlap operation between blocks. In the case where the MDCT method is used, a bit rate is not increased.

The normalization unit 130 performs normalization to a transformed speech signal in operation S120. As described above, the normalization unit 130 may group domain-transformed speech signal data into a plurality of sub-bands, and may perform normalization to frequency band coefficients for each sub-band with energy for each sub-band. For instance, in the case where 80 frequency band points are grouped into 16 sub-bands, each sub-band may include 5 MDCT coefficients.

Thereafter, the differentiation unit 150 differentiates a voiced sound or unvoiced sound period from a normalized speech signal in operation S150. As described above, the differentiation unit 150 may receive a spectral tilt obtained during the decoding process of the decoder 110, and may differentiate a voiced sound period when the spectral tilt is equal to or greater than a certain value. For instance, in the case where the decoder 110 is the CELP-type speech decoder, the differentiation unit 150 may differentiate the voiced sound period by extracting spectral tilt information from information outputted from the decoder 110. In the case of the decoder 110 using G.729, during a decoding process, a primary reflection coefficient, i.e. St, may be obtained and differentiated through Equation (3).

In the case of the voiced sound period, the voiced sound processing unit 151 extracts the first period including the harmonic period calculated on the basis of the above-described pitch information in operation S140. In the case of the unvoiced sound period, the unvoiced sound processing unit 152 extracts a period most correlated to a normalized speech signal as the second period on the basis of correlation in operation S135. Each of the processing units 151 and 152 amplifies bandwidth for each extracted period, and changes the amplified period into a high band in operation S150.

The voiced sound processing unit 151 may extract the harmonic period from a period differentiated as voiced signals of a normalized speech signal by using the pitch information obtained from the decoder 110. The first period may include a plurality of periods as harmonic periods, or the first period may be plural. As described above, the unvoiced processing unit 152 may determine cross-correlation for each frequency period for a period determined as unvoiced sounds in a normalized speech signal, and may extract a period having a highest degree of cross-correlation to thereby obtain the second period. Since a bandwidth of an obtained period is reduced to a half of a desired extension bandwidth, each of the processing units 151 and 152 amplifies the bandwidth, and changes the amplified period into a high band.

Thereafter, the energy adjusting unit 160 adjusts energy scale of the outputted first period or second period in operation S160. As described above, the energy adjusting unit 160 may serve to avoid an abrupt energy change when transformation into a high-band signal is performed by adjusting each coefficient of the MDCT speech signal of the first or second period. Therefore, the energy adjusting unit 160 matches energy on a boundary portion between a low-band speech signal and a speech signal obtained by changing the first period or second period to a high band so as to adjust an abrupt energy change through scale adjustment.

The speech signal synthesis unit 180 synthesizes a scale-adjusted high-band speech signal and a low-band speech signal, i.e. a low-band speech signal, in order to obtain a wideband signal in operation S170, and transforms the obtained signal into a wideband speech signal to output the transformed signal in operation S180. The speech signal synthesis unit 180 may perform inverse MDCT for speech synthesis and transform, and may perform speech synthesis using the above described QMF method in order to synthesize a wideband speech signal.

Figure 4:
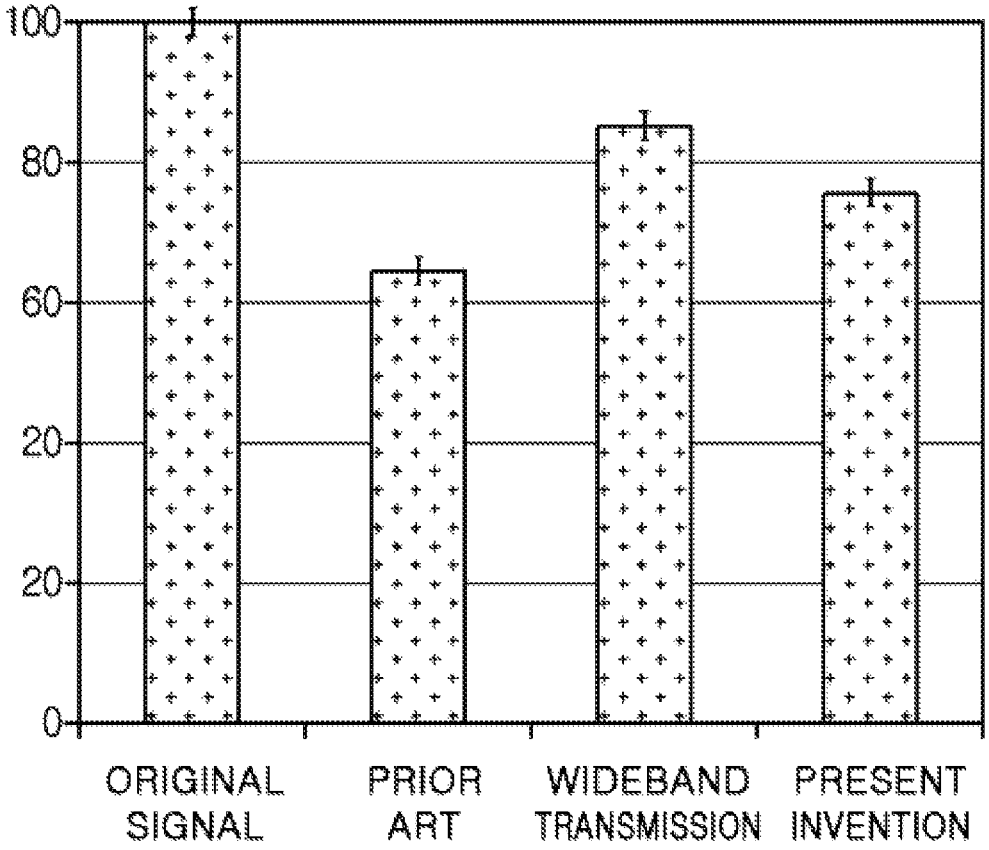
FIG. 4 is a diagram illustrating a result of testing a method for extending a bandwidth of a speech signal according to an embodiment of the present invention.

FIG. 4 is a graph illustrating a result of testing performance of the bandwidth extension device 100 according to an embodiment of the present invention.

For this test, the MUSHRA test (ITU/ITU-R BS 1534, Method for Subjective Assessment of Intermediate Quality Level of Coding Systems, 2001) was conducted, and spectrums were compared with each other to measure sound quality. For the MUSHRA test, 3 men speech files and 3 women speech files from a speech quality assessment material (SQAM) database (EBU, Sound Quality Assessment Material Recording for Subjective Tests, 1988) were used.

In particular, since an SQAM speech file is sampled in stereo at a rate of 44.1 kHz, the speech file was down-sampled to 8 kHz and 16 kHz respectively and regenerated as a mono signal. This is for generating signals processed according to a related art (G.729) and an embodiment of the present invention for a sound source down-sampled to 8 kHz. A sound source down-sampled to 16 kHz is for obtaining a signal processed by a typical wideband transmission technology (G.729.1). 7 experimenters without auditory problem participated in the test. The experimenters assigned scores from 0 to 100 for the above-described 6 files for each test file.

As a result of the MUSHRA test, as illustrated in FIG. 4, the present invention had a score of about 75.5 in comparison with a score of 100 for an original sound. This score is higher than a score of about 66 for G.729 that is a conventional narrowband process and output technology, and is lower than a score of about 87 for a wideband transmission technology (G.729.1 (layer 3)) in which additional bits are allocated to generate a wideband signal. However, it may be understood that, without using additional bits, the sound quality is improved by about 43% in comparison with the typical narrowband transmission technology G.729 and the sound quality is not greatly degraded in comparison with the technology using additional bits.

FIGS. 5 to 8 are graphs illustrating signal spectrums for comparing the bandwidth extension method of FIG. 4 according to an embodiment of the present invention with other technologies.

Figure 5:
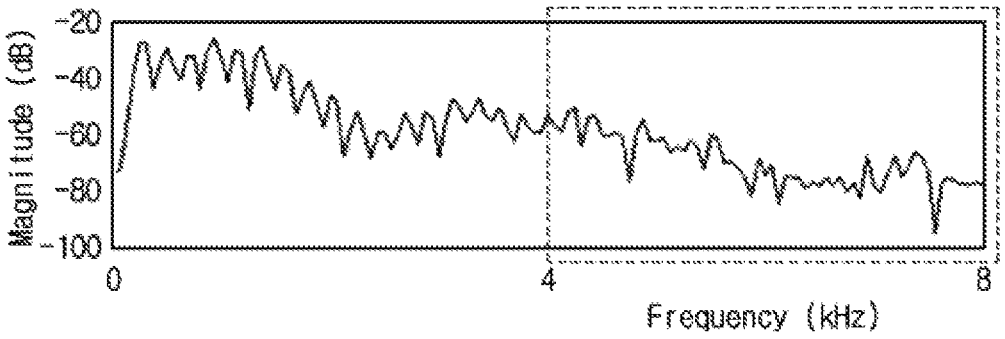
FIGS. 5 to 8 are graphs illustrating signal spectrums for comparing the bandwidth extension method of FIG. 4 according to an embodiment of the present invention with other technologies.

FIG. 5 illustrates a spectrum of an original sound before being transmitted. The high-band portion of FIG. 5 is not transmitted when a narrowband is transmitted.

Figure 6:
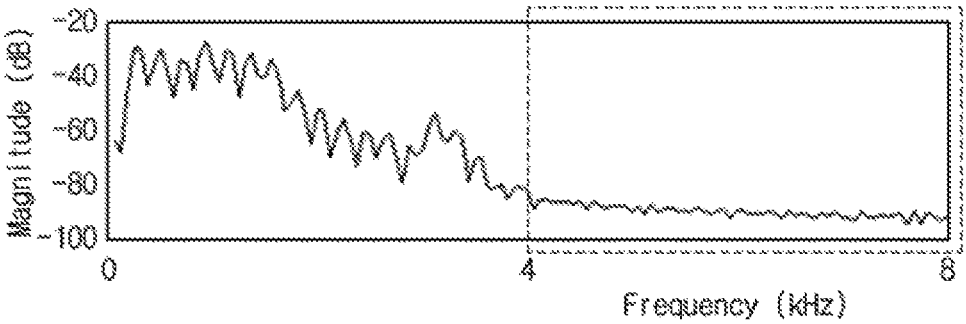

FIG. 6 illustrates a spectrum of a signal restored by a conventional narrowband output technology (G.729). As illustrated in FIG. 6, it may be understood that the sound quality is degraded since speech data of a high-band portion of a prior art are not restored.

Figure 7:
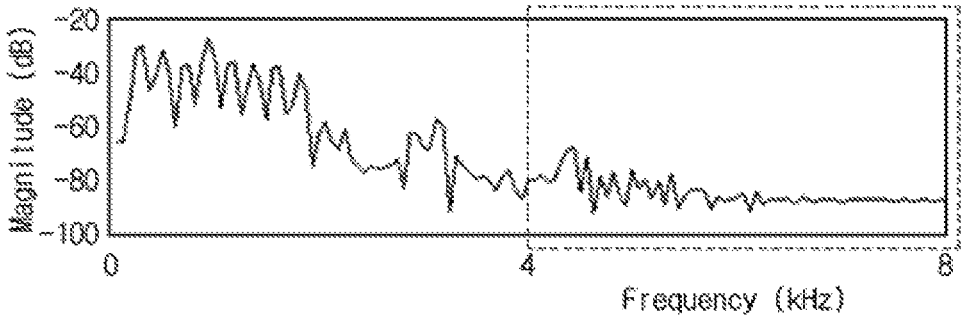

FIG. 7 illustrates a spectrum of a signal restored by a typical wideband transmission technology (G.729.1) using additional bits. As illustrated in FIG. 7, it may be understood that data of a high-band portion are not completely restored even if the wideband transmission technology is used. In the case of using this technology, computational complexity increases due to additional bits and equipment needs to be replaced.

Figure 8:
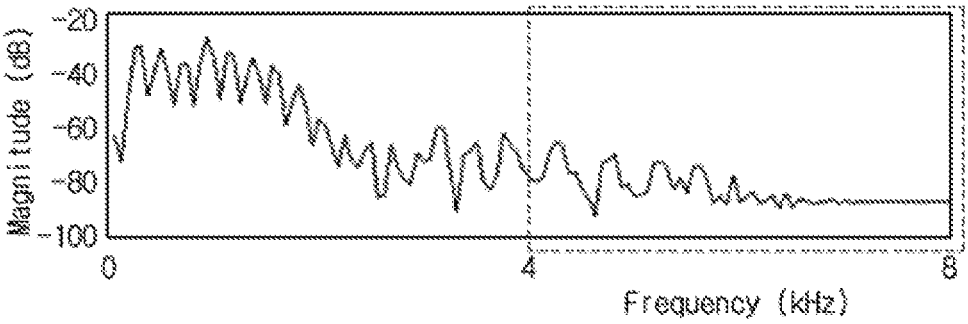

FIG. 8 illustrates a spectrum of a signal obtained by receiving a narrowband signal (e.g. a signal coded by G.729) and restoring the received signal into a wideband signal according to an embodiment of the present invention. As illustrated in FIG. 8, it may be understood that a high-band portion is a little bit different from that of an original sound, but is improved in comparison with the prior art of FIG. 6. Further, it may be understood that this result is not greatly different from that of the wideband transmission using additional bits.

Therefore, according to the embodiments of the present invention, without allocating additional bits, the sound quality can be improved due to post-processing in a decoder. Further, according to the embodiments of the present invention, a communication bandwidth between terminals can be secured maintaining high sound quality, and, since an established network does not need to be replaced or modified, the time and cost for installing wideband equipment can be reduced.

According to the present invention, without additional bits, a high-quality wideband speech signal can be outputted from a narrowband speech signal.

In particular, since voiced and unvoiced sounds are differentiated to perform different operations, computational complexity can be reduced and the sound quality can be improved.

Further, according to the embodiments of the present invention, without modifying a configuration of a decoder of a conventional narrowband speech signal system, the system can be improved to a wideband system, thereby reducing cost for wideband speech service.

The bandwidth extension method according to the present invention may be implemented as a program to be executed in a computer and may be stored in a computer-readable recording medium. The computer-readable recording medium includes a ROM, a RAM, a CD-ROM, a magnetic tape, a floppy disk, and an optical data storage device. Further, the methods may also be implemented as a form of a carrier wave (for example, transmission via the Internet).

The computer-readable recording medium may be distributed to computer systems connected to a network so that computer-readable codes may be stored and executed in a distribution manner. Further, a function program, a code, and code segments for implementing the methods may be easily derived by programmers skilled in the technical field to which the present invention belongs.

Although the method and device for extending a bandwidth of a speech signal have been described with reference to the specific embodiments, it(they) is(are) not limited thereto. Therefore, it will be readily understood by those skilled in the art that various modifications and changes can be made thereto without departing from the spirit and scope of the present invention defined by the appended claims.

What is claimed is:

1. A method for extending a bandwidth of a speech signal received, the method comprising:

transforming the received speech signal into a frequency domain by decoding the received speech signal;

normalizing the transformed speech signal;

differentiating a voiced sound period or unvoiced sound period from the received speech signal;

extracting, from the normalized speech signal, a first period including a harmonic component of the voiced sound period on the basis of the voiced sound period;

extracting, from the normalized speech signal, a second period on the basis of correlation between the unvoiced sound period and the normalized speech signal;

generating a high-band speech signal on the basis of the first period and the second period; and synthesizing the generated high-band speech signal and the transformed speech signal to output a wideband speech signal.

2. The method of claim 1, wherein the differentiating of the voiced or unvoiced sound period comprises:

extracting a spectral tilt from the received speech signal; and differentiating the voiced sound period when the extracted spectral tilt is greater than a preset value.

3. The method of claim 1, wherein the extracting of the first period comprises:

extracting pitch information from the received speech signal;

obtaining a harmonic period of the voiced sound period on the basis of the extracted pitch information; and extracting the harmonic period as the first period.

4. The method of claim 1, wherein the extracting of the second period comprises extracting, from the unvoiced sound period, a period most correlated to the normalized speech signal as the second period.

5. The method of claim 1, wherein the generating of the high-band speech signal comprises:

changing a bandwidth of at least one of the first and second periods into a high frequency band; and compensating for energy of the changed period to generate the high-band speech signal.

6. The method of claim 5, wherein the compensating for the energy comprises:

dividing the normalized speech signal into a plurality of first sub-bands according to a frequency band;

dividing a speech signal of the changed period into a plurality of second sub-bands;

obtaining scaling coefficients on the basis of the first sub-bands and the second sub-bands; and compensating for the energy of the changed period by using the scaling coefficients.

7. A device for extending a bandwidth of a speech signal, the device comprising:

a receiving unit configured to receive a speech signal;

a decoder configured to decode the speech signal;

a domain transform unit configured to transform the decoded speech signal into a frequency domain;

a normalization unit configured to normalize the transformed speech signal;

a determination unit configured to differentiate a voiced sound period or unvoiced sound period from the received speech signal;

a voiced sound processing unit configured to extract, from the normalized speech signal, a first period including a harmonic component of the voiced sound period on the basis of the voiced sound period;

an unvoiced sound processing unit configured to extract, from the normalized speech signal, a second period on the basis of correlation between the unvoiced sound period and the normalized speech signal;

a high-band generation unit configured to generate a high-band speech signal on the basis of the first period and the second period; and an output unit configured to synthesize the generated high-band speech signal and the transformed speech signal to output a wideband speech signal.

8. The device of claim 7, wherein the differentiation unit extracts a spectral tilt from the received speech signal and differentiates the voiced sound period when the extracted spectral tilt is greater than a preset value.

9. The device of claim 7, wherein the voiced sound processing unit extracts pitch information from the received speech signal, obtains a harmonic period of the voiced sound period on the basis of the extracted pitch information; and extracts the harmonic period as the first period.

10. The device of claim 7, wherein the unvoiced sound processing unit extracts, from the unvoiced sound period, a period most correlated to the normalized speech signal as the second period.

11. The device of claim 7, wherein the high-band generation unit changes a bandwidth of at least one of the first and second periods into a high frequency band and compensates for energy of the changed period to generate the high-band speech signal.

12. The device of claim 11, wherein the high-band generation unit compensates for the energy of the changed period by using scaling coefficients obtained on the basis of the normalized speech signal divided into a plurality of sub-bands according to a frequency band and a speech signal of the changed period divided into a plurality of second sub-bands.

* * * * *